US007428764B2

(12) United States Patent
Clark

(10) Patent No.: US 7,428,764 B2
(45) Date of Patent: Sep. 30, 2008

(54) DISCRETE ORTHOGANOL SUPPORT SYSTEM

(76) Inventor: John D. Clark, 924 Blackwood Ave., Tallahassee, FL (US) 32303

( * ) Notice: Subject to any disclaimer, the term of this patent is extended or adjusted under 35 U.S.C. 154(b) by 315 days.

(21) Appl. No.: 11/214,381

(22) Filed: Aug. 29, 2005

(65) Prior Publication Data

US 2007/0044241 A1 Mar. 1, 2007

(51) Int. Cl.
*A47C 27/14* (2006.01)

(52) U.S. Cl. ..... 5/727; 5/729; 5/655.9

(58) Field of Classification Search ..... 5/727, 5/729, 740, 655.9
See application file for complete search history.

(56) References Cited

U.S. PATENT DOCUMENTS

| | | | | | |
|---|---|---|---|---|---|
| 2,192,601 | A | * | 3/1940 | Mattison | 5/729 |
| 3,310,819 | A | * | 3/1967 | Morrison | 267/143 |
| 3,401,411 | A | * | 9/1968 | Morrison | 5/655.8 |
| 3,623,171 | A | * | 11/1971 | Arkin | 5/718 |
| 4,053,957 | A | | 10/1977 | Regan | |
| 4,265,484 | A | | 5/1981 | Stalter | |
| 4,429,427 | A | * | 2/1984 | Sklar | 5/654.1 |
| 4,476,594 | A | | 10/1984 | McLeod | |
| 4,682,818 | A | * | 7/1987 | Morell | 297/452.27 |
| 4,753,480 | A | | 6/1988 | Morell | |
| 4,835,034 | A | | 5/1989 | Cruz | |
| 5,160,785 | A | | 11/1992 | Davidson, Jr. | |
| 5,294,181 | A | | 3/1994 | Rose et al. | |
| 5,327,596 | A | * | 7/1994 | Wallace et al. | 5/655.7 |
| 5,327,598 | A | * | 7/1994 | Liou | 5/652.1 |
| 5,604,021 | A | | 2/1997 | Wagner | |
| 6,093,468 | A | | 7/2000 | Toms et al. | |
| 6,654,960 | B2 | | 12/2003 | Cho | |
| 7,000,277 | B2 | * | 2/2006 | Torres Cervera | 5/719 |
| 7,200,884 | B2 | * | 4/2007 | Wright et al. | 5/717 |
| 2004/0074007 | A1 | * | 4/2004 | Gladney | 5/727 |
| 2005/0066446 | A1 | * | 3/2005 | Gladney | 5/690 |
| 2005/0081298 | A1 | * | 4/2005 | Wright et al. | 5/690 |
| 2005/0108827 | A1 | * | 5/2005 | Cervera | 5/740 |
| 2005/0166330 | A1 | * | 8/2005 | Williams | 5/740 |
| 2006/0248652 | A1 | * | 11/2006 | Alonso Cucurull | 5/740 |

* cited by examiner

*Primary Examiner*—Patricia Engle
*Assistant Examiner*—Gilbert Y Lee
(74) *Attorney, Agent, or Firm*—J. Wiley Horton

(57) ABSTRACT

A low-profile multilayer cushion assembly which can be used to support the human body under various conditions. The cushion assembly generally includes a top layer of supportive material having a relatively high compression modulus, a middle layer of woven material, and a bottom layer. The bottom layer includes a matrix of supportive material having a relatively low compression modulus and an arrangement of inserts spread throughout the matrix having a relatively high compression modulus. In the preferred embodiment closed-cell polyurethane foam is used for the top layer and inserts, and open-cell polyurethane foam is used for the bottom layer matrix. The inserts are adhesively attached to the matrix to provide additional resistance to buckling. An optional protective cover encases the bottom layer, middle layer, and top layer.

1 Claim, 4 Drawing Sheets

DISCRETE ORTHOGANOL SUPPORT SYSTEM

BACKGROUND OF THE INVENTION

1. Field of the Invention

This invention relates to the field of cushions. More specifically the present invention comprises a low-profile multilayer cushion assembly which can be used to support the human body under various conditions.

2. Description of the Related Art

Many cushions and devices for supporting parts of the human body are known in the prior art. These devices come in many different designs and configurations. One example of such a device is described in U.S. Pat. No. 4,265,484 to Stalter (1981). Stalter describes a polyurethane formed body support member having a plastic reinforcing member and foam on either side of the plastic reinforcing member. The Stalter device utilizes the plastic reinforcing member to distribute the load evenly across the layer of foam under the reinforcing member.

Another cushioning device is exemplified by U.S. Pat. No. 5,294,181 to Rose et al. (1994). Rose et al. discloses a seat cushion made of layers of polyurethane foam, each layer having a different density. The Rose et al. device utilizes a sloping base layer to support an intermediate foam layer having a pair of laterally spaced recesses to accommodate the user's legs. A top layer having a range of protrusions and valleys is employed on top of the intermediate layer.

Many other cushions are known in the prior art, but are not discussed herein. Despite the existence of these types of cushions there remains a need for a low-profile cushion assembly that is supportive, comfortable, and that can be employed for a variety of cushioning applications.

BRIEF SUMMARY OF THE INVENTION

The present invention comprises a low-profile multilayer cushion assembly which can be used to support the human body under various conditions. The cushion assembly generally includes a top layer of supportive material having a relatively high compression modulus, a middle layer of woven material, and a bottom layer. The bottom layer includes a matrix of supportive material having a relatively low compression modulus and an arrangement of inserts spread throughout the matrix having a relatively high compression modulus. In the preferred embodiment closed-cell polyurethane foam is used for the top layer and inserts, and open-cell polyurethane foam is used for the bottom layer matrix. The inserts are adhesively attached to the matrix to provide the primary support. The matrix material provides additional resistance to buckling. An optional protective cover encases the bottom layer, middle layer, and top layer.

FIG, 3B is a perspective view, showing an insert.

Figure 3A:
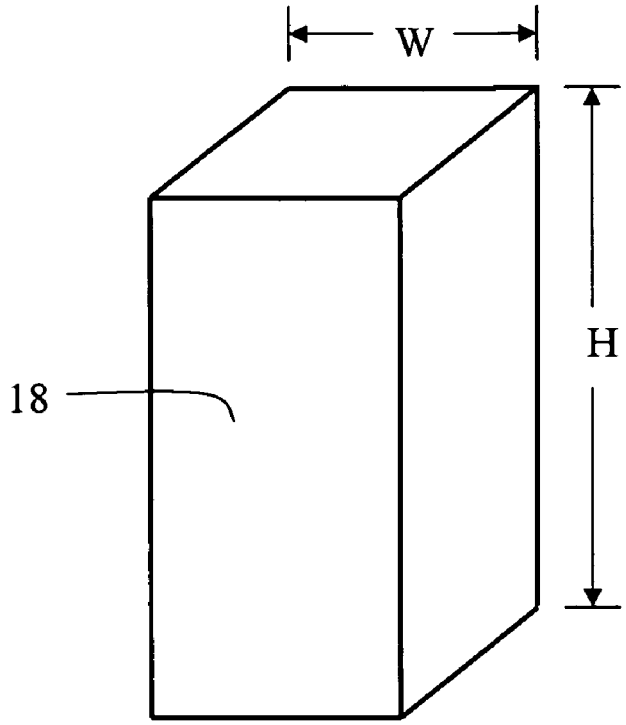
FIG. 3A is a perspective view, showing an insert.
Figure 3B:
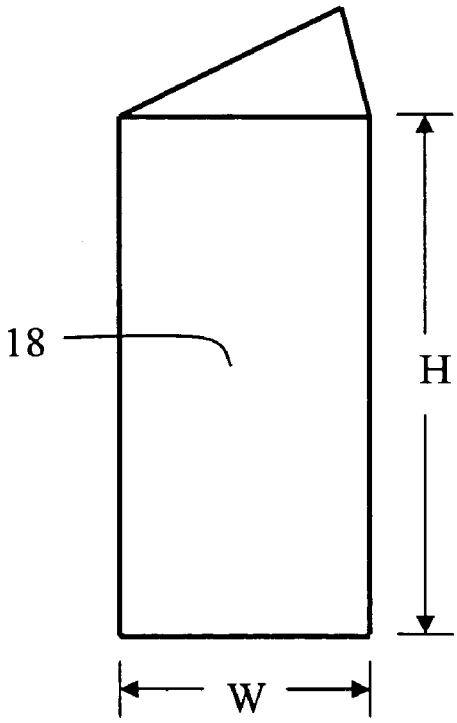
Figure 3C:
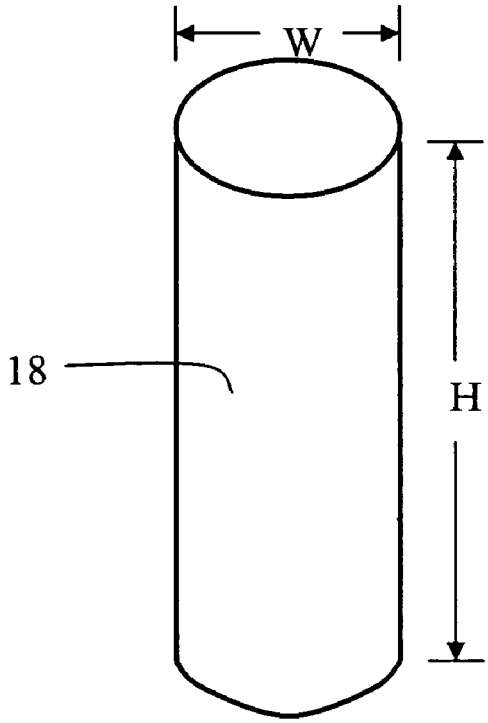

FIG. 3C is a perspective view, showing an insert.

Figure 4:
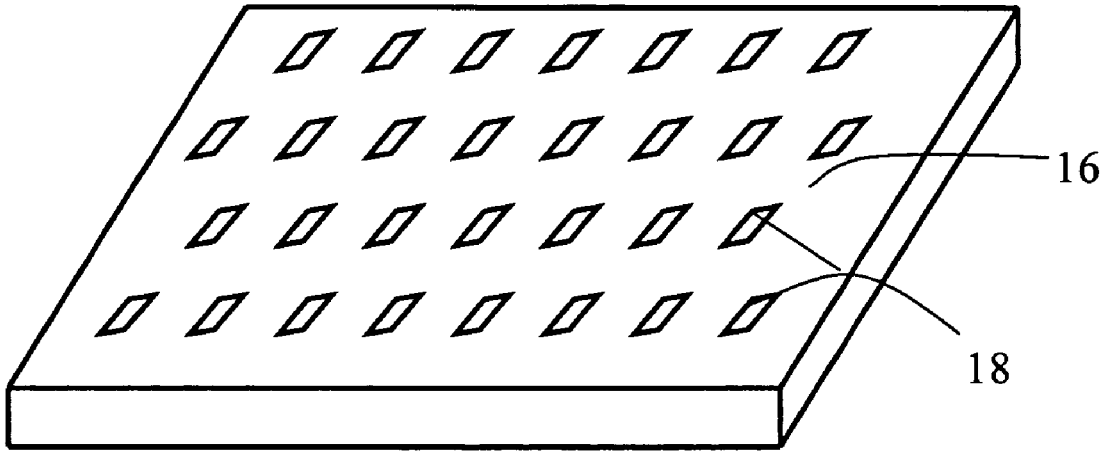

FIG. 4 is a perspective view, showing an alternate embodiment of the present invention.

REFERENCE NUMERALS IN THE DRAWINGS

| | | | |
|---|---|---|---|
| 10 | cushion assembly | 12 | middle layer |
| 14 | bottom layer | 16 | matrix |
| 18 | insert | 20 | cover |
| 22 | top layer | W | narrowest effective width |
| H | height | | |

DETAILED DESCRIPTION OF THE INVENTION

Figure 1:
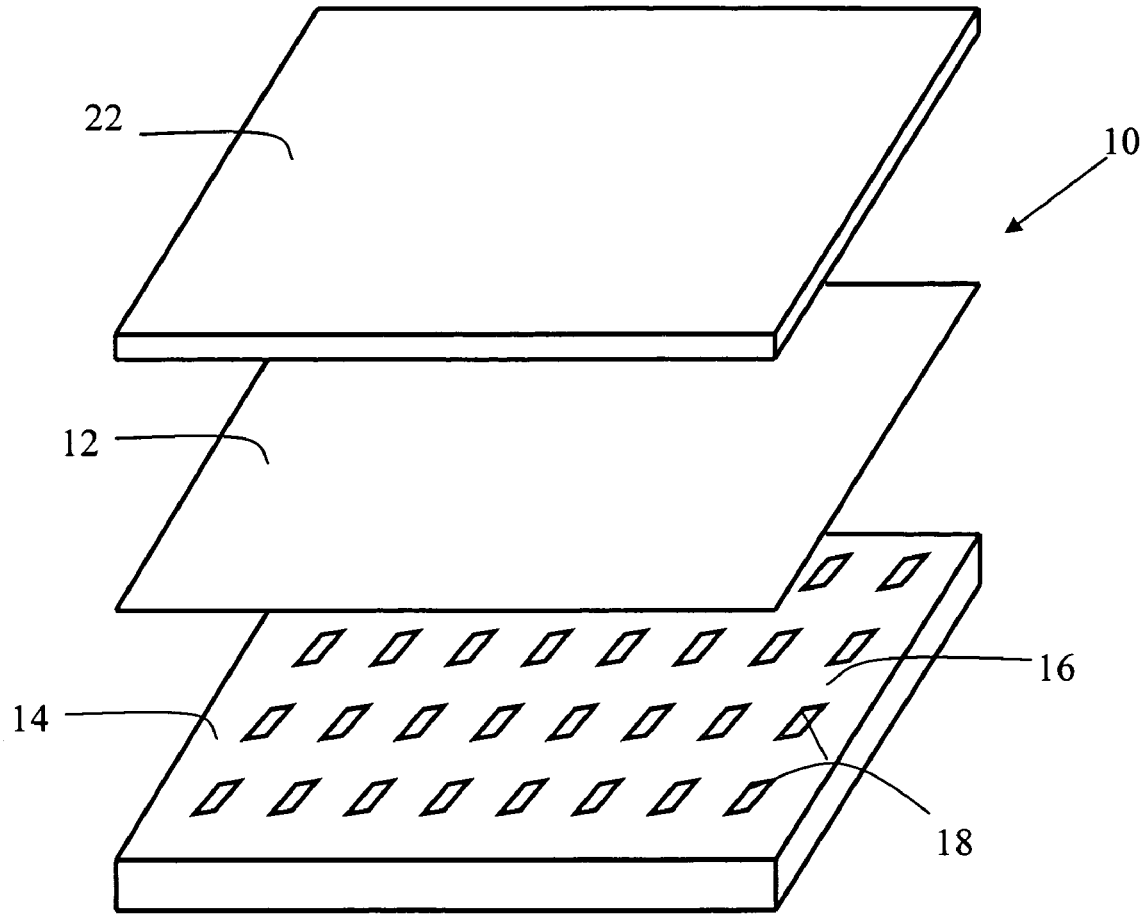
FIG. 1 is an exploded view, showing the present invention.

The present invention, cushion assembly 10, is shown in FIG. 1. Cushion assembly 10 is of multilayer construction having top layer 22, middle layer 12, and bottom layer 14. In the preferred embodiment, the different layers are bonded together with glue or other adhesive. Top layer 22 is generally composed of a supportive material having a high compression modulus. Bottom layer 14 generally includes matrix 16 which is composed of a supportive material having a low compression modulus and a plurality of inserts 18 situated within matrix 16. Inserts 18 are preferably made of a supportive material having a high compression modulus. Middle layer 12 is situated between top layer 22 and bottom layer 14 and is preferably composed of a woven material such as cloth. Although cloth is the preferred material, other deformable materials can be used that are relatively inextensible in the plane of the material.

Those that are skilled in the art know that compression modulus describes how "supportive" a material is, particularly a foam material. In the context of foam, compression modulus is the ratio of a foam's ability to support a force at different levels of displacement or compression. Compression modulus can be computed for a material by taking the ratio of the material's indentation force deflection ("IFD") at 25 percent indentation ($IFD_{25\%}$) and 65 percent indentation ($IFD_{65\%}$) as shown in EQ. 1 below.

$$\text{Compression Modulus} = IFD_{65\%}/IFD_{25\%} \qquad \text{[EQ. 1]}$$

Indentation force deflection is determined by taking the force in pounds required to indent or compress a piece of foam a specified percentage of its total height (typically a total height of 4 inches is used) with a surface area of 50 square inches. For example, a foam that has a IFD at 65% indentation of 100 pounds (meaning that the height is compressed 65% when subjected to a force of 100 pounds) and an IFD at 25% indentation of 50 pounds has a compression modulus of 2.0 (compression modulus values for polyurethane foam typically range from 1.8 to 3.0).

Compression modulus for polyurethane foam is a function of the density of the foam and the structure of the foam. Generally, compression modulus increases as foam density increases. Also, different chemical formulations and manufacturing processes can be used to create foams with different foam cell structures. Foams with high concentration of closed cells (closed-cell foam) typically have a higher compression modulus than foams with high concentration of open cells (open-cell foam).

Returning to FIG. 1, top layer 22 and inserts 18 are preferably made of closed-cell polyurethane foam while matrix 16 is preferably made of a lower density open-cell polyurethane foam. Different materials can also be used for any of the components, but matrix 16 preferably has a lower compression modulus than inserts 18 and top layer 22, the purpose for which will be explained subsequently.

Figure 2:
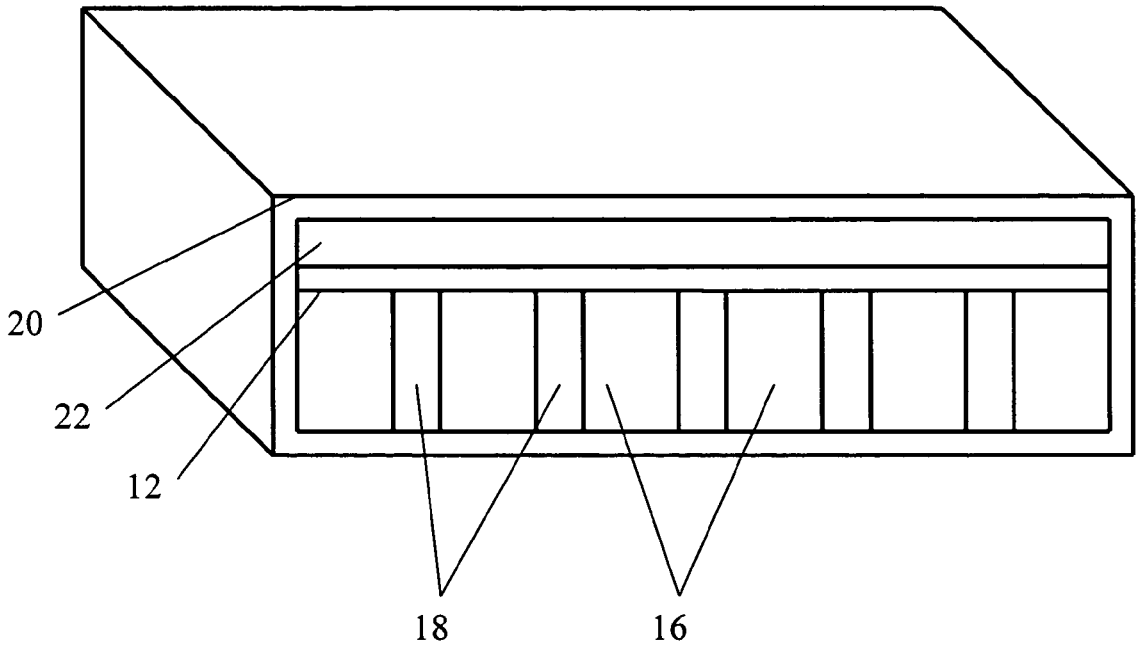
FIG. 2 is a section view, showing the present invention.

A section view representation of the present invention is shown in FIG. 2. The reader will observe that inserts 18 pass completely through matrix 16 so that the top of insert 18 is substantially flush with the top of bottom layer 12 and the bottom of insert 18 is substantially flush with the bottom of bottom layer 12. Inserts 18 are positioned substantially perpendicular to top layer 22, the purpose for which will be explained subsequently. Cover 20 encases cushion assembly 10 to protect the cushion and provide additional support.

The functionality of each of the layers will now be considered in greater detail. Cover 20 and top layer 22 transmit and distribute the compressive load across the top surface of cushion assembly 10. The load is transmitted through top layer 22 to bottom layer 12. Inserts 18 act as the principal support means for bottom layer 22. Inserts 18, based on their geometry, tend to both compress and buckle when subjected to compressive loading. Matrix 16 both provides additional support against compressive loading and provides resistance against inserts 18 tendency to buckle. Inserts 18 are preferably adhesively bonded within matrix 16. The adhesive integrates insert 18 and matrix 16 so that the components of bottom layer 22 act in unison. The adhesive further provides additional resistance to the buckling of inserts 18. Although matrix 16 and the adhesive provide resistance to buckling, the controlled buckling of inserts 18 is desirable as will be explained subsequently. Middle layer 22 functions to distribute the compressive load across the surface of bottom layer 12 and prevents bottom layer 12 from tearing.

Example geometries for insert 18 are shown in FIGS. 3A, 3B, and 3C. The preferred embodiment of insert 18, a rectangular prism, is shown in FIG. 3A. The reader will observe that insert 18 has a substantially square cross section. Narrowest effective width W denotes the narrowest side of the cross section. Since the cross section of insert 18 is a square, narrowest effective width W describes all of the sides of the square cross section. If a rectangular cross section is used, narrowest effective width W would describe the shortest sides of the rectangular cross section. Height H describes the height of insert 18 when it is situated in its normal vertical orientation. In the preferred embodiment, height H is greater than narrowest effective width W to encourage insert 18 to buckle when subjected to a compressive load. Buckling occurs when insert 18 bends out-of-plane. Those that are skilled in the art know that this mode of failure is distinguishable from pure compression which involves longitudinal deflection with some degree of lateral bulging.

Other various angular or curvilinear cross-section geometries for insert 18 can be used, including but not limited to, triangular as shown in FIG. 3B and circular as shown in FIG. 3C. In FIG. 3B, narrowest effective width W describes the shortest side of the triangular cross section. In FIG. 3C, narrowest effective width W describes the diameter of the circle. While other geometries not shown or described herein can also be used, in each of these designs it is preferred that height H be greater than narrowest effective W to encourage buckling.

The relationship and integration between the various components of the present invention will be now considered together. As described previously, top layer 22 acts as a "loading plate" to distribute the compressive load across as much of the cushion as possible while still providing a responsive surface that is both supportive and comfortable. Although a more rigid top layer would distribute the compressive load across the top of cushion assembly 10 more evenly, it would not provide the desired responsive surface and could cause the user discomfort at various pressure points. Accordingly, a polyurethane foam having high compression modulus is a good choice for top layer 22. Since matrix 16 generally has a lower compression modulus than inserts 18, inserts 18 act as principal support columns for the "loading plate." Because inserts 18 are spread throughout matrix 16, cushion assembly 10 can be more responsive to uneven loading thus eliminating discomfort caused by pressure points. For example, if cushion assembly 10 is used for a seat cushion, inserts 18 will compress and buckle to a greater degree under the points of higher loading such as the parts of the cushion supporting the user's legs and coccyx.

The preceding description contains significant detail regarding the novel aspects of the present invention. It should not be construed, however, as limiting the scope of the invention but rather as providing illustrations of the preferred embodiments of the invention. As an example, inserts 18 can be spaced throughout matrix 16 in various configurations. Inserts 18 are presented in a simple grid format in FIG. 1, but alternating grid lines can also be used as shown in FIG. 4. Inserts 18 can also be placed in nonlinear format. Such a variation would not alter the function of the invention. Also, a single component may be used to perform the functions of the top and middle layer. Thus, the scope of the invention should be fixed by the following claims, rather than by the examples given.

Having described my invention, I claim:

1. A cushion assembly comprising:

a. a top layer;

b. a bottom layer having a top side and a bottom side, said bottom layer including i. a matrix of supportive material, said matrix of supportive material comprising open-cell polyurethane foam;

ii. a plurality of inserts, said plurality of inserts situated within said matrix of supportive material, each of said plurality of inserts having a top, a bottom, and a length therebetween, said length having an outward facing surface, said plurality of inserts comprising closed-cell polyurethane foam;

iii. wherein said top of each of said plurality of inserts is proximal to said top side of said bottom layer, and said bottom of each of said plurality of inserts is proximal to said bottom side of said bottom layer so that said length of each of said plurality of inserts is positioned substantially perpendicular to said top side and said bottom side of said bottom layer;

iv. wherein said closed-cell polyurethane foam has a greater compression modulus than said open-cell polyurethane foam;

v. wherein said plurality of inserts are bonded to said matrix of supportive material such that said matrix and said plurality of inserts mechanically interact when said cushion assembly is subjected to a compressive load; and vi. wherein said plurality of inserts are configured to both compress and buckle when said cushion assembly is subjected to said compressive load.

* * * * *